United States Patent [19]

Burgat et al.

[11] 4,033,096

[45] July 5, 1977

[54] APPARATUS FOR OPENING BAGS

[75] Inventors: Georges Burgat, Saint-Didier-Au-Mont-D'Or; Bernard Guillemaut, Lyon, both of France

[73] Assignee: Thimmonier S.A., Lyon, France

[22] Filed: May 11, 1976

[21] Appl. No.: 685,144

[30] Foreign Application Priority Data

May 12, 1975 France ..... 75.15559

[52] U.S. Cl. ..... 53/386; 53/188

[51] Int. Cl.[2] ..... B65B 43/30

[58] Field of Search ..... 53/386, 188, 190, 292

[56] References Cited

UNITED STATES PATENTS

| | | | |
|---|---|---|---|
| 2,722,358 | 11/1955 | Wilson | 53/386 X |
| 2,781,620 | 2/1957 | Hopkins et al. | 53/188 X |

*Primary Examiner*—Travis S. McGehee

*Attorney, Agent, or Firm*—Karl F. Ross; Herbert Dubno

[57] ABSTRACT

An apparatus for opening bags of the synthetic-resin foil type in which the bags are successively drawn from a horizontal magazine by a movable suction member displaceable horizontally, are brought into the proximity of a further suction member raised between the bag and the magazine and are then drawn open between the suction members. The bag is then laterally engaged by a pair of guide-pincer members and guided thereby onto the clamping pincers of a carriage to be shifted to a filling station along the transport path of this carriage.

9 Claims, 10 Drawing Figures

APPARATUS FOR OPENING BAGS

FIELD OF THE INVENTION

The present invention relates to an apparatus for the opening of small bags and, more particularly, to a device capable of seizing the bags in succession from a magazine, opening them and disposing them in such manner as to enable them to be carried to a filling station for ultimate filling.

BACKGROUND OF THE INVENTION

There have been provided heretofore devices for opening synthetic-resin foil bags to enable their filling at an appropriate station along a transport path of a carrier for such bags. Synthetic-resin foil bags, of the type with which the present invention is concerned, are generally supplied from the bag-fabrication machinery in the form of stacks of flattened bags. The bags may be simple sacks of rectangular outline and formed with three rectolinear sides in which the synthetic-resin foils are thermally fused together along seams. Alternatively, they may be bags of the type commercially available under the designation "DOYPACK" of the type described in U.S. Pats. Nos. 3,380,646, 3,637,133 and 3,935,993 and in which a pair of substantially rectangular thermoplastic panels are formed at their bottoms with gussets or a bottom panel of substantially inverted-V cross section so that the section of the bottom has a W-cross section. The insert panel is thermally welded to the main wall panels over a curvilinear seam or straight seams having the configuration of a trapezoid. The insert panel permits the bottom of the bag to be spread apart and permits the bag to be essentially self-standing, when filled.

There are two main systems conventially used for opening such bags.

In a first such system, the bags are withdrawn from a magazine or stack, in which they are stored flat, by a suction member and are then introduced into the pincers of a support mounted on a transfer conveyor. At a station downstream from the opening device the bags are filled. The opening device, downstream from the magazine and upstream from the filling station, is provided with vacuum ramps along which the bag is carried and which spread the lips of the open end of the bag. Air at low pressure is blown into the spread mouth of the bag to inflate the latter.

In a second system, the bag-opening arrangement comprises a vacuum means for spreading the lips of the mouth of the bag and a mechanical element which is introduced through the open end to spread apart the walls of the bag to the bottom.

These two systems have significant disadvantages in practice.

In the case of the first system, especially when thin-foil bags are to be opened and the opening is difficult, an elevated pressure is developed within the bag which is propagated towards the bottom quite vigorously to generate a shock wave which is able to rupture the foil of the bag. Furthermore, for certain types of bags it is almost impossible to effect their opening by inflation and it is possible to note a substantial percentage of unopened bags on the machine.

In the second type of bag-opening apparatus, the introduction of a mechanical member into the fragile bag is capable of causing deterioration of the film from which it is constituted. In addition, the deep introduction of a mechanical element into a bag which is being displaced horizontally relatively rapidly is difficult to synchronize with the bag-translation device. As a consequence it is necessary to reduce the speed of translation and hence the rate at which bags can be supplied to a filling station. Mechanical engagement of the opening member with the walls of the bag is liable to cause damage thereto.

Both of the prior-art devices described above are characterized by the need to provide the bag-opening device downstream from the magazine and upstream from the filling station. This requirement for a separate bag-opening station between the magazine and the filling station increases the size of the machine and makes it necessary to provide a relatively large apparatus for opening and filling such bags.

OBJECTS OF THE INVENTION

It is an important object of the present invention to provide a bag-opening apparatus in which the aforementioned disadvantages are avoided.

Another object of this invention is to provide a bag-opening apparatus, especially for bags of the above-described "DOYPACK" type or thin-foil synthetic-resin bags, e.g. of polyethylene, which can precisely position the open bags, can substantially guarantee opening of all of the bags and avoids any damage to the bags even when the latter are composed of thin films.

SUMMARY OF THE INVENTION

These objects and others which will become apparent hereinafter are attained, in accordance with the present invention, in an apparatus for the opening of flat foil bags, preferably supplied in a stack from the bag-fabrication apparatus, which comprises, in combination, a first movable member provided with suction elements turned toward the horizontally disposed stack and displaceable horizontally towards the latter to engage the panel of the bag at the end of the stack confronting this first member, a second movable member provided with suction elements turned in the opposite direction, i.e. toward the suction elements of the first member and displaceable vertically between an upper position in which it is disposed between the stack and the first member, and a lower position in which it clears the path of the first member in its movement toward the stack, and a pair of clamping pincers engageable with the lateral edges of a sack and into which the sack can be placed by the movable members.

According to an important feature of the invention, the second member is thereupon lowered to entrain the open bag downwardly with the pincers acting as lateral guides to prevent closing of the bag, the open bag passing into the carriage which is provided with another set of pincers engageable with the lateral edges of the bag below the first set of pincers to carry the bag away to the filling station.

The two movable members provided with suction elements according to the invention are thus able to provide all of the essential functions of bag-opening directly in the region of the magazine. Thus, while the second member is initially in its lower position, the first member advances toward the stack and is capable of undergoing a forward-back reciprocating movement, whereupon the second member is raised to engage the back of the bag. The next forward-return movement of the first member brings the bag into engagement with the suction elements of the second member and opens the bag by spreading apart the panels thereof which are engaged by the two sets of suction elements. In the final phase of the operation, only the suction elements of the second member are maintained under vacuum and the second member descends again to carry the bag between the guide elements of the upper pincer and deposit the bag in the carriage to enable it to be displaced to the filling station.

According to a feature of the invention, the upper or first set of pincers comprises arms pivotally mounted for swinging movement about vertical axes and disposed between the first member and the carriage, i.e. below the first member and above the carriage, the arms being formed with clamping bodies engageable with the lateral edges of the bag and forming vertical guides therefor. These bodies guide the bag downwardly during its displacement by the second member onto the carriage.

These movable arms close upon the longitudinal weld seams of the bag after the opening thereof and serve as guides during translation of the bag to a lower position in which the bag is engaged by a second set of pincers preferably mounted upon the carriage and of the edge-clamping type.

According to still another feature of the invention, the second member is formed at an upper portion with an abutment, e.g. a fork, which is disposed above the upper edge of the bag when the latter is drawn from the magazine or stack by the first member and engages this upper edge of the bag as the second member is lowered to push the bag downwardly in the guide bodies mentioned previously. With this abutment or fork the upper edge of the bag can be positioned precisely in the carriage to facilitate the filling of the bag at the filling station.

BRIEF DESCRIPTION OF THE DRAWING

The above and other objects, features and advantages of the invention will become more readily apparent from the following description, reference being made to the accompanying drawing which is a diagram illustrating an apparatus for opening bags and provided as a non-limiting example. In the drawing.

SPECIFIC DESCRIPTION

Figures 1, 2:
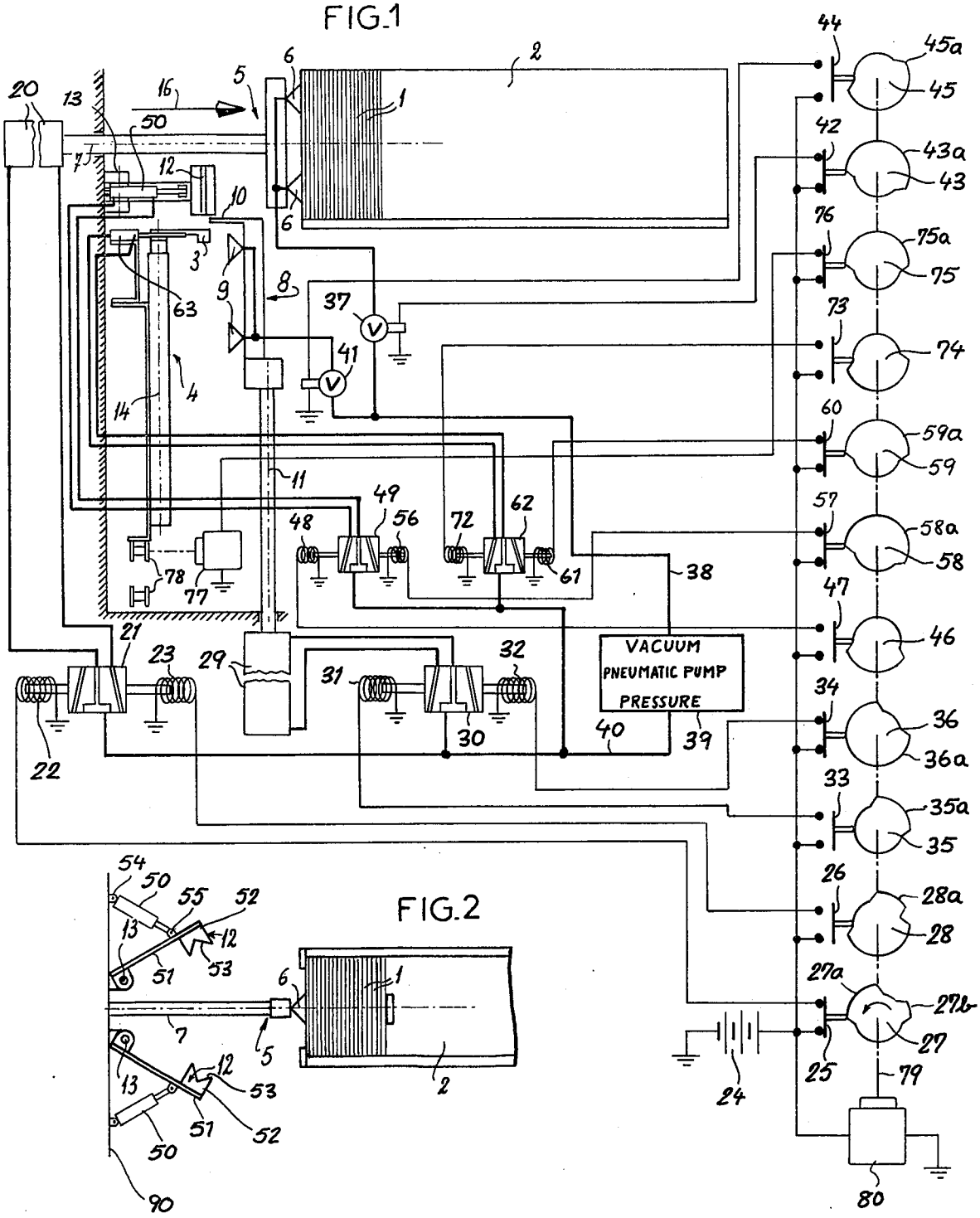
FIG. 1 is a side-elevational view of the apparatus in the first phase of its operative cycle.
FIG. 2 is a top plan view of the device in the position corresponding to FIG. 1.

The apparatus shown in the drawing is intended to open, in succession, sacks 1 disposed in a stack in a magazine 2 so that the flat bags lie vertically while the stack extends horizontally. The bags, after opening, are inserted into the clamping pincers 3 of a carriage 4 for transporting the bags to a filling station. The principal elements of the device according to the invention and their relative positions are the following:

A first movable member 5 carrying suction elements or cups 6 turned toward the first bag 1 of the magazine 2 is displaceable parallel to the horizontal axis 7 of the magazine.

A second movable member 8, carrying the suction elements or cups 9 turned in a direction opposite to the first cups is provided at its upper end with an abutment fork 10 and is displaceable along a vertical axis 11 located in the same plane as the axis 7 of the magazine 2.

Two movable pincers 12, disposed below the axis 7, are pivotally mounted on vertical axes 13.

The clamping pincers 3 of the bag carriage 4 are disposed below the pincers 12 and are also pivotally mounted on vertical axes 14.

The carriage 4 is displaceable in translation horizontally by rollers, not shown, on horizontal rails 15 perpendicular to the axis 7 of the magazine 2.

Figure 9:
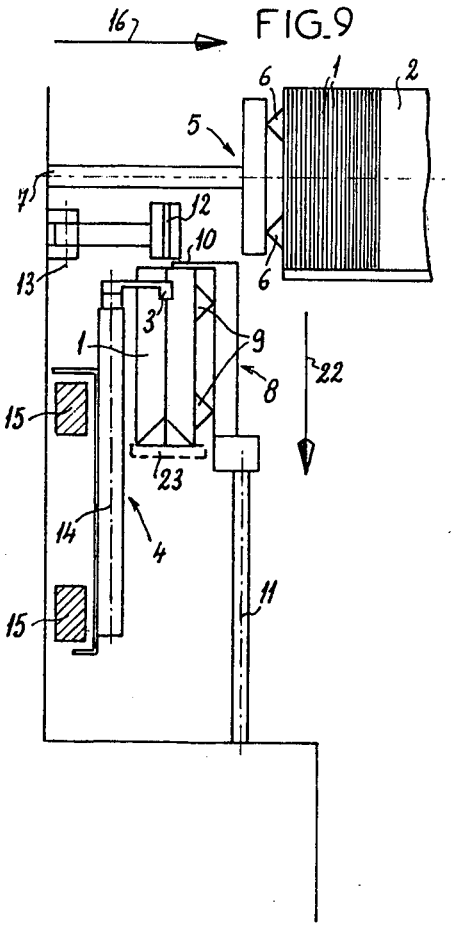
FIGS. 9 and 10 are analogous views illustrating the fifth and last phase of the operating cycle.

It is to be noted that, for clarity of ullustration, certain of the elements described above are not shown in all of the Figures. However FIGS. 1 and 9 show together the complete apparatus.

Conventional timing and control means, such as pneumatic cylinders, suction pumps and the like are provided to displace the movable members 5 and 8, the movable pincers 12, the carriage 4 and the parts thereof and to provide the suction for the cups 6 and 9. Suitable control means for this purpose will be readily apparent to the skilled worker in the art.

The apparatus functions cyclically and, for each cycle, carries out the following phases of operation:

Initially the two movable members 5 and 8 are in the position shown in FIGS. 1 and 2. The member 8 is in its lower position while member 5 advances toward the magazine 2 as illustrated by the arrow 16 until its suction cups 6 come into contact with the first bag 1 at the proximal end of the stack. During this first phase, the guide pincers 12 are in an open position as shown particularly in FIG. 2.

Figure 3:
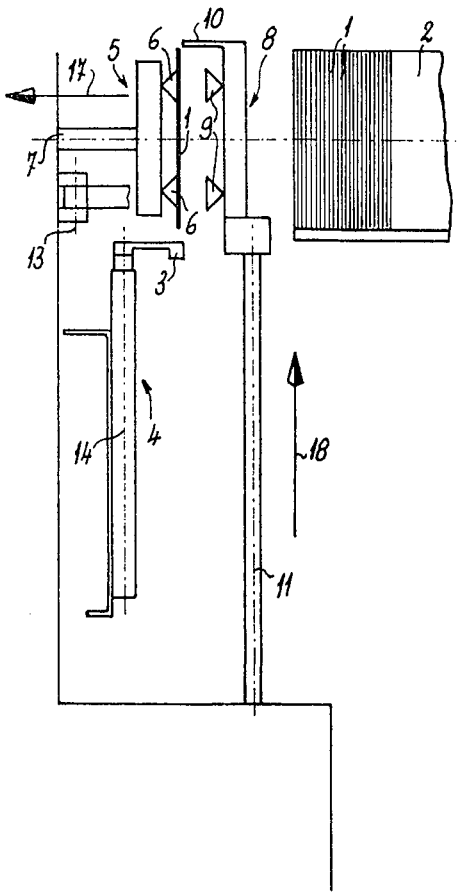
FIG. 3 is a partial side-elevational view of the apparatus in the second phase of its operation.
Figure 4:
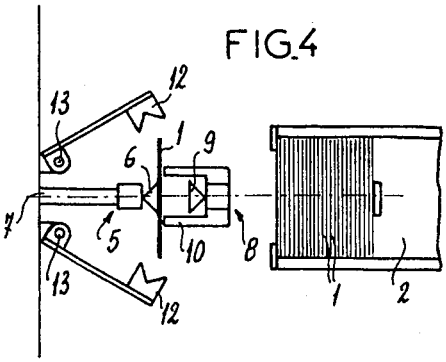
FIG. 4 is a top plan view of the apparatus in its position corresponding to FIG. 3.

In the subsequent (second) phase, corresponding to FIGS. 3 and 4, the member 5 is withdrawn as illustrated by arrow 17, entraining with it the first bag 1 from the magazine, the suction cups 6 having been placed under vacuum. The other movable member 8 rises as illustrated by arrow 18 and is positioned in its upper position between the magazine 2 and the first member 5 so that the suction cups 6 and 9 are face to face. The fork 10 is thus located just above the upper edge of the bag 1.

Figure 5:
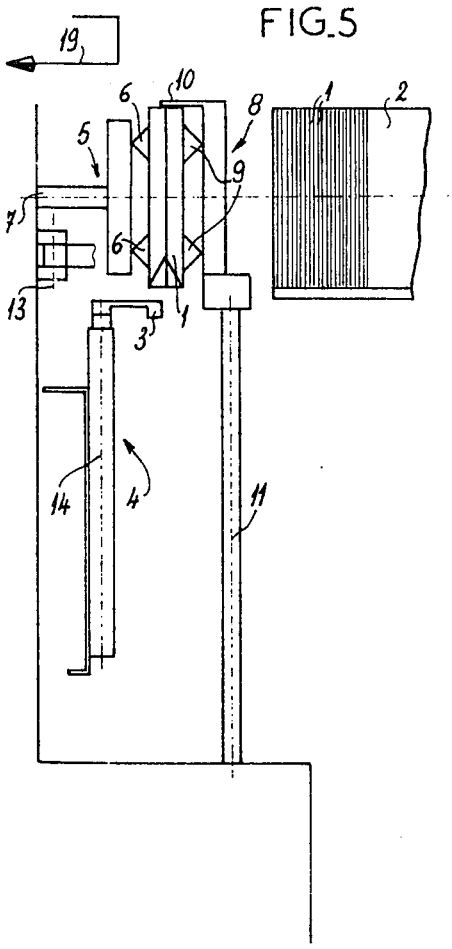
FIGS. 5 and 6 are views analogous to FIGS. 3 and 4, respectively, corresponding to a third phase of the cycle.
Figure 6:
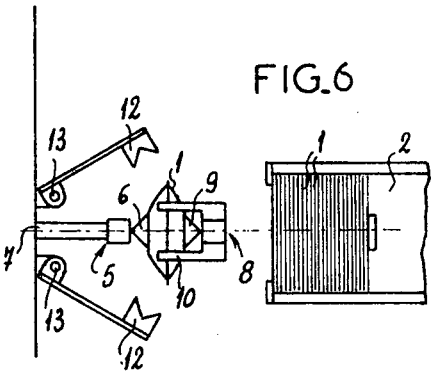

During the third phase, illustrated in FIGS. 5 and 6, the movable member 5, on whose suction cups 6 the bag is retained in a flat condition, advances anew to bring the bag against the suction cups 9 of member 8 which is stationary during this period. The suction cups 9 are evacuated and member 5 returns as indicated by arrow 19, which represents a back-and-forth movement. As the member 5 returns to the left (FIG. 5) the bag 1 has its opposite lateral panels held by the evacuated suction cups 6 and 9, the panels being spread apart, thereby opening the bag over its entire length. Even the W-section bottom of a DOYPACK bag is thereby opened (see FIGS. 5 and 6).

Figure 7:
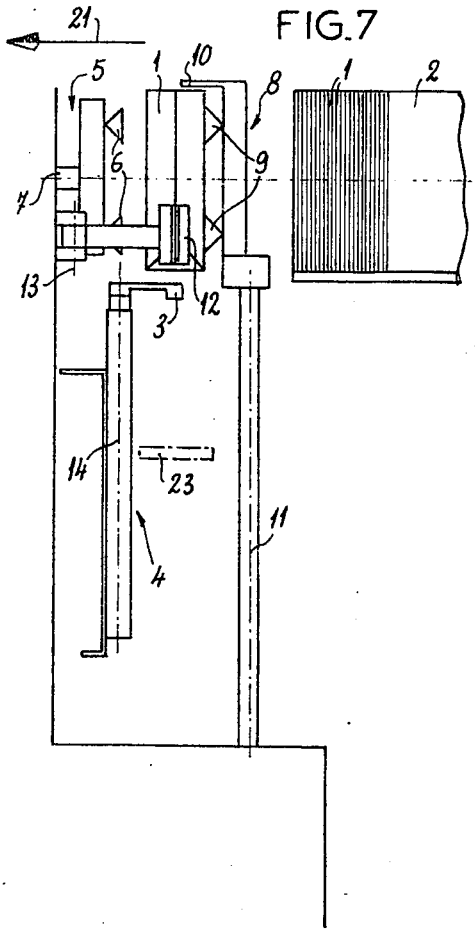
FIGS. 7 and 8 are views analogous to FIGS. 3 and 4 illustrating a fourth phase.

When the bag 1 is completely opened, the pincers 12 swing about their vertical axes 13 (arrows 20 in FIG. 8) so that the guide bodies in these pincers laterally engage the bag and close against the longitudinal seams of the latter. By slight inward pressure between the pincers, the bag is held in its open condition as the suction in the cups 6 and 9 is relieved, member 5 continuing to return to the left as represented by arrow 21 in FIG. 7.

Figure 8:
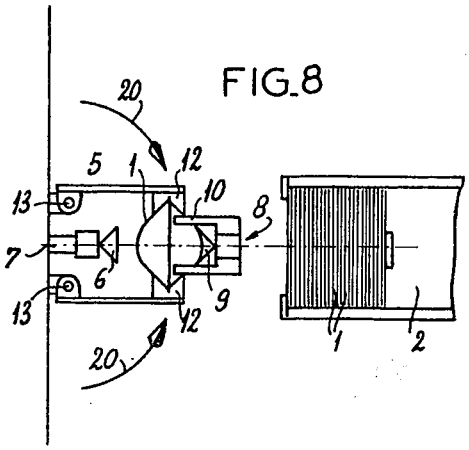
Figure 10:
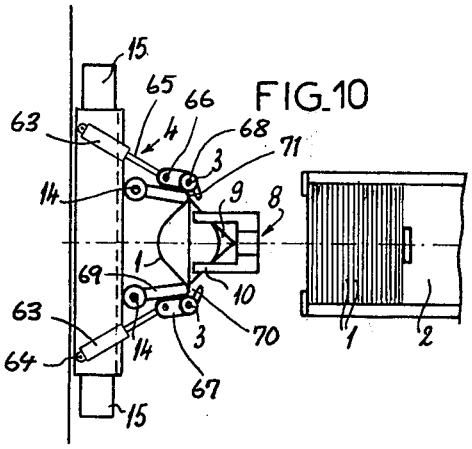

In the fifth and last phase of the operating cycle, corresponding to FIGS. 9 and 10, the movable member 8 is lowered (arrow 22), entraining with it the open bag 1. This bag slides within the pincers 12 which are maintained in their closed position as seen in FIG. 8 to form guides for the longitudinal seams of the bag. The bag is thereupon inserted into the open lower pincers 3 and, when the bag is in place, the pincers 3 close on the longitudinal seams. The fork 10, which presses the upper edge of the bag downwardly and facilitates the movement of the latter, positions the bag with considerable precision in the pincers 3 of the carriage 4.

The suction cups 9 may, of course, remain evacuated during this downward movement of member 8. If they have remained evacuated during this phase of the operation, they can then be relieved so that the apparatus is ready for the next cycle. During the downward movement of member 8, member 5 can begin its forward movement (arrow 16) and once the downward movement of member 8 has ceased, the carriage 4 can shift along its rails 15 to position a new bag in alignment with the pincers 12.

In FIG. 1. we have shown, somewhat diagrammatically, means which can be used to actuate the various elements to accomplish the aforementioned cycle of operation.

For example, the rod 7 of suction member 5 can be horizontally displaced (arrows 16, 17 and 19) by a pneumatic cylinder 20 which is connected to a valve 21 operated by either of two solenoids 22*a* and 23, the latter being energized from an electrical current source 24 via switches 25 and 26 under the control of respective cams 27 and 28. Correspondingly, the rod 11 of movable member 8 can be vertically displaced (arrows 18 and 22) by a double acting piston 29 energized through a valve 30 whose solenoids 31 and 32 can be energized by respective switches 33 and 34 of cams 35 and 36.

To apply suction to the cups 6, the latter may be connected via a valve 37 to a suction line 38 from a pneumatic pump arrangement 39 which also delivers air under pressure via line 40 to the valves 21 and 30. Suction can also be communicated via line 38 and a valve 41 to the suction cups 9 of member 8. Valve 37 is electrically energized by a switch 42 controlled by a cam 43 while valve 41 is operated electrically by a switch 44 controlled by cam 45. When the valves are de-energized, the suction cups are automatically vented.

The controlled system also comprises a cam 46 which operates a switch 42 in circuit with a solenoid 48 of a valve 49 to which air under pressure may be fed from line 40 to cylinders 50 (see also FIG. 2) which operate the arms 51 of pincers 12.

The pincers 12 have guide bodies 52 formed with V-section channels 53 in which the correspondingly shaped longitudinal edges of the bag are downwardly guided when the arms 51 are swung toward one another from their positions shown in FIG. 2. The cylinders 50 can be pivotally secured at 54 to a support 90 on which the rod 7 is slidably mounted while its piston is articulated at 55 to the arm 51.

The other solenoid 56 of valve 49 is energized by a switch 57 operated by a cam 58.

A cam 59 operates switch 60 which energizes one solenoid 61 of still another valve 62 controlling the pressurization of a pair of cylinders 63 (see also FIG. 10) mounted upon a carriage 4 which is guided along the aforementioned rails 15. Each of the cylinders 63 can be pivotally connected (at 64) to the carriage 4, while its piston 65 is articulated at 66 to a lever 67 of the clamping pincers 3. The lever 67, which is fulcrumed at 68 on an arm 69 constituting a part of the clamping pincers and swingable about the axis 14 carries a finger which, with continued excursion of the piston rod (after the arm 69 has been swung into position opposite the seam) seizes the longitudinal edges or seams 71 of the bag 1 from the other side.

The other solenoid 72 of valve 62 is energized by a switch 73 operated by a cam 74. A cam 75 operates switch 76 to energize a motor 77 which drives the chain 78 for displacing the carriage 4.

The timing of the sequence described above is controlled by the formations on the respective cams which are synchronously driven, e.g. by a common shaft 79 of a timing motor 80.

For example, when the switch 25 is closed by the formation 27*a* of cam 27 to energize solenoid 22*a* and shift the valve 21 into the position shown, the cylinder 20 is pressurized to displace member 5 in the direction of arrow 16. Simultaneously, the formation 36*a* of cam 36 will hold the valve 30 in a position corresponding to the lowered position of member 8.

The formation 58*a* of cam 58 closes the switch 57 to hold the valve 49 in a position in which it maintains the arms 51 of pincers 12 in their outwardly swung position (FIG. 2) while switch 60 is closed by the formation 59*a* of cam 59 to maintain the pincers 3 in their open positions. The formation 75*a* of cam 75 can meanwhile operate motor 77 to position a new carriage 14 in proper alignment with the opening device while the formation 43*a* of cam 43 closes switch 42 to apply suction to the cups 6.

As described above in connection with the valve phases of the operation, when the rod 7 has reached its full excursion, the recess 27*b* of cam 27 allows switch 25 to open while formation 28*a* of cam 28 closes switch 26 to reverse member 5. Simultaneously, the formation 35*a* of cam 35 closes switch 33 to shift the valve 30 and permit member 8 to rise. When the member 8 is in its fully elevated position, the formation 45*a* of cam 45 closes valve 44 to apply suction at cups 9. The remaining operations in the sequence are of course performed with the other recesses and lands of the cams.

The advantages of this apparatus can be summarized as follows:

The apparatus is extremely compact since it enables opening of the bags fully at the same location along the transport path of the carriages at which the magazine or stick is disposed. The operations of withdrawal of the bag from the stack and opening are thus carried out at the same place.

Experience with the apparatus has shown that it is possible to open all kinds of sacks, including those having relatively rigid walls and those having extremely supple or flexible walls since practically any number of suction cups may be disposed in appropriate positions for the respective sacks.

The system does not deform the bottom of the bag during opening and does not cause wear or stresses in the bags because it does not apply any superatmospheric pressure to the interior thereof and does not introduce any mechanical element to effect the opening.

The apparatus can be used for various purposes. For example it has been found to be especially effective for opening DOYPACK bags and for opening ordinary flat foil bags. It can be operated entirely automatically so as to coordinate with a filling machine, means for sealing the mouth of the bag and means for packaging the filled bags. It can be used in semi-automatic installations in which a manual or semi-manual device is associated with the apparatus of the invention for opening the bags.

It will be readily apparent that the invention is not limited to the specific embodiment illustrated and described. For example, the invention also embraces variants within the scope of the claims. For example, it is possible to eliminate the magazine 2 and to provide the opening apparatus directly adjacent a machine for synchronously fabricating the bags and, of course, with a system for synchronously filling them. The structure of the members 5 and 8 can be modified by increasing the number of suction cups or even by eliminating the fork 10 although the latter has been found entirely advantageous. For example, a fixed support 23 may serve to abut the bottom of the bags for positioning thereof when the fork is eliminated (see FIGS. 7 and 9).

We claim:

1. An apparatus for opening a flat vertically disposed bag having a pair of opposite panels and open at the tops of said panels, said apparatus comprising:

a first member displaceable horizontally and formed with a first suction element juxtaposed with one of said panels and first means for displacing said member with forward movement and reverse movement whereby said first suction element is brought into engagement with said bag during said forward movement and entrains said bag during said reverse movement from a supply of such bags;

a second movable member and second means for displacing same vertically into a position between said first member and said supply, said second member having a suction element turned toward the suction element of the first member for engagement with said second panel upon a succeeding forward movement of said first member towards said second member, said first means displacing said first member thereafter away from said second member with said suction elements engaging said panels apart and open said bag, said second means displacing said second member vertically out of alignment with said first member into another position; and conveyor means provided with a first pincer device engageable with said bag in said other position of said second member.

2. The apparatus defined in claim 1, further comprising a pair of guide pincers laterally engageable with said bag and aligned with pincers of said conveyor means for guiding said bag into the pincers of said conveyor means upon displacement of said second member into said other position.

3. The apparatus defined in claim 2 wherein said second pincers comprise a pair of arms swingable about a vertical axis and a pair of guide bodies laterally engaging edges of said bag for guiding same.

4. The apparatus defined in claim 3 wherein said conveyor means is disposed below said first member and said second pincers are disposed below said first member and above said conveyor means, said second member being movable downwardly into said other position.

5. The apparatus defined in claim 4 wherein said second member is provided at an upper portion thereof with an abutment engageable with an upper edge of a bag held in said second pincers for displacing said bag downwardly.

6. The apparatus defined in claim 5 wherein said supply is a horizontal magazine containing a stack of said bags.

7. The apparatus defined in claim 6, further comprising horizontal guides perpendicular to the axis of said magazine for said conveyor means.

8. The apparatus defined in claim 7 wherein the pincers of said conveyor means are swingable about vertical axes on a carriage displaceable along said guides.

9. An apparatus for opening a flat vertically disposed bag having a pair of opposite panels and open at the tops of said panels, said apparatus comprising:

a first member displaceable horizontally and formed with a first suction element juxtaposed with one of said panels and first means for displacing said member with forward movement and reverse movement whereby said first suction element is brought into engagement with said bag during said forward movement and entrains said bag during said reverse movement from a supply of such bags;

a second movable member and second means for displacing same vertically into a position between said first member and said supply, said second member having a suction element turned toward the suction element of the first member for engagement with said second panel upon a succeeding forward movement of said first member towards said second member, said first means displacing said first member thereafter away from said second member with said suction elements engaging said panels to spread said panels apart and open said bag, said second means displacing said second member vertically out of alignment with said first member into another position; and conveyor means engaging said bag in said other position of said second member for carrying said bag away therefrom.

* * * * *